US011364408B2

(12) United States Patent
Charnitski

(10) Patent No.: US 11,364,408 B2
(45) Date of Patent: Jun. 21, 2022

(54) EXERCISE DEVICE

(71) Applicant: Richard Charnitski, Mission Viejo, CA (US)

(72) Inventor: Richard Charnitski, Mission Viejo, CA (US)

( * ) Notice: Subject to any disclaimer, the term of this patent is extended or adjusted under 35 U.S.C. 154(b) by 0 days.

(21) Appl. No.: 16/820,317

(22) Filed: Mar. 16, 2020

(65) Prior Publication Data

US 2020/0289873 A1 Sep. 17, 2020

Related U.S. Application Data

(60) Provisional application No. 62/819,175, filed on Mar. 15, 2019.

(51) Int. Cl.
*A63B 21/00* (2006.01)

(52) U.S. Cl.
CPC ..... *A63B 21/154* (2013.01); *A63B 21/4035* (2015.10)

(58) Field of Classification Search
CPC ..... A63B 21/154; A63B 21/4035; A63B 23/1236; A63B 21/005; A63B 21/008; A63B 21/023; A63B 23/03525; A63B 23/03541; A63B 7/00; A63B 23/1209; A63B 21/068; A63B 7/02; A63B 7/04; A63B 21/00185; A63B 21/156; A63B 22/001; A63B 22/0056; A63B 22/0058; A63B 2022/0043; A63B 22/04; A63B 2023/006; A63B 23/035; A63B 23/03516
See application file for complete search history.

(56) References Cited

U.S. PATENT DOCUMENTS 2,716,027 A * 8/1955 Gehri ..... A63B 21/023 482/131
3,858,874 A * 1/1975 Weider ..... A63B 21/154 482/131
4,084,815 A * 4/1978 Flannery ..... A63B 21/06 482/131
4,257,592 A * 3/1981 Jones ..... A63B 21/154 24/115 K
4,738,444 A * 4/1988 Linden ..... A63B 7/02 482/128
5,178,590 A * 1/1993 Stephens ..... A63B 7/02 482/23
5,556,369 A * 9/1996 Roberts ..... A63B 17/00 482/131
6,241,642 B1 * 6/2001 Slenker ..... A63B 21/015 482/114

(Continued)

*Primary Examiner* — Garrett K Atkinson
*Assistant Examiner* — Kathleen M Fisk
(74) *Attorney, Agent, or Firm* — Woods, Phillips, Katz, Clark & Mortimer

(57) ABSTRACT

An exercise or training device that includes a first pulley, a second pulley, and a two ended line trained through the first and second pulley, the line having a first end and a second end, the first end of the line affixed to a first handle for gripping, a second handle for gripping affixed to the line at a position between the first end and the second end of the line. The pulleys may be fixed in position to a wall or rack such that they are horizontally spaced apart. In some embodiments, the pulley or pulleys may be attached to the fixed position by a spring assembly or other device to increase the linear force in the handles or bar.

6 Claims, 7 Drawing Sheets

(56) References Cited

U.S. PATENT DOCUMENTS

| | | | | |
|---|---|---|---|---|
| 6,267,711 | B1 * | 7/2001 | Hinds | A63B 1/00 482/121 |
| 7,255,666 | B2 * | 8/2007 | Cardenas | A61H 1/0229 482/143 |
| 8,696,521 | B2 * | 4/2014 | Wu | A63B 21/4034 482/35 |
| 8,944,976 | B2 * | 2/2015 | Crowell | A63B 21/068 482/125 |
| 9,427,370 | B2 * | 8/2016 | Fair | A63B 21/4043 |
| 9,764,177 | B2 * | 9/2017 | Baudhuin | A63B 21/151 |
| 2007/0015644 | A1 * | 1/2007 | Aucamp | A63B 21/154 482/130 |
| 2016/0199683 | A1 * | 7/2016 | Shamlin | A63B 21/4015 482/130 |
| 2021/0038941 | A1 * | 2/2021 | Marti | A63B 23/1209 |

* cited by examiner

EXERCISE DEVICE

BACKGROUND OF THE INVENTION

Field of the Invention

The invention relates to the field of exercise and training devices, and more particularly to exercise devices that use the users own body weight to provide the force, weight, or resistance for the exercise. The invention also relates to exercise devices that include a stirrup, bar, handle, or other grasping or suspension device suspended from fixed positions overhead by a line, cable, rope, webbing or other flexible elongate structure. The invention also relates to exercise devices that are quickly and easily adjustable to accommodate a variety of user sizes, positions, and exercises. The invention also relates to exercise and training devices that can be used for bi-lateral and unilateral exercises. The invention also relates to exercise and training devices that can quickly and easily adjust from bi-lateral to unilateral exercises.

SUMMARY OF THE INVENTION

The present invention provides an exercise or training device that includes a first pulley, a second pulley, and a two ended line trained through the first and second pulley, the line having a first end and a second end, the first end of the line affixed to a first handle for gripping, a second handle for gripping affixed to the line at a position between the first end and the second end of the line. The pulleys may be fixed in position to a wall or rack such that they are horizontally spaced apart. In some embodiments, the pulley or pulleys may be attached to the fixed position by a spring assembly or other device to increase the linear force in the handles or bar.

In other embodiments, the invention includes the first pulley and second pulley affixed in a horizontally spaced apart relationship. One skilled in the art will recognize that a pulley encompasses any device that allows a line, rope, cable, webbing, or other flexible elongate structure to be supported while moving and change direction.

In other embodiments the first handle for gripping is attached to the first end of the line by a carabiner. In other embodiments the second handle for gripping is selectively secured to the line at any point between the second end of the line and the second pulley. In other embodiments the invention includes a first pulley, a second pulley spaced horizontally apart from the first pulley, and a two ended line trained through the first and second pulley, the line having a first end terminating at a first carabiner, and having a second carabiner attached to the line by a rope clamp at a position between the second pulley and the second end of the line.

In other embodiments of the invention, one or both pulleys are connected to a fixed position such as a wall, ceiling, or rack, by a spring assembly. Placing a spring or other assembly that resists the downward force applied by the user when the users pulls on the rope, increases the linear force the user must overcome.

In other embodiments, the invention includes a bar removably attached to the first end of the line and the second end of the line. In other embodiments, the bar includes a sleeve that freely rotates about the major axis of the bar. The bar may include eyes at the first and second ends of the bar, the eyes being used to attach the bar to the first and second ends of the line. In some embodiments, the eyes are attached to the first and second ends of the line by first and second carabiners, shackles, clutches, clamps, or other structures that allow the easy or quick attachment and removal of equipment to lines, cables, and ropes.

In one form, the invention is directed to an exercise device including: a first pulley, a second pulley, and a two ended line trained through the first and second pulley. The line has a first end and a second end. The first end of the line is affixed to a first handle for gripping. A second handle for gripping is affixed to the line at a position between the first end and the second end of the line.

In one form, the first pulley and second pulley are affixed in a horizontally spaced apart relationship.

In one form, the first handle for gripping is attached to the first end of the line by a carabiner.

In one form, the second handle for gripping is selectively secured to the line at any point between the second end of the line and the second pulley.

In one form, the second handle for gripping is selectively secured to the line by means of a rope clamp.

In one form, the invention further includes a third handle positioned above the second handle and a fourth handle positioned above the first handle.

In one form, the invention further includes a spring assembly having a first end and a second end. The first end is attached to the pulley. The second end is attached to a first fixed position.

In one form, the invention further includes a second spring assembly having a first end and a second end. The first end of the second spring assembly is attached to the second pulley. The second end of the second spring assembly is attached to a second fixed position horizontally displaced from the first fixed position.

In one form, the invention is directed to an exercise device including a first pulley, a second pulley spaced horizontally apart from the first pulley, and a two ended line trained through the first and second pulley. The line has a first end terminating at a first carabiner. A second carabiner is movably attached to the line by a rope clamp at a position between the second pulley and the second end of the line.

In one form, a bar is attached to the first carabiner and the second carabiner. The bar is positioned above a user's head to facilitate pull-up exercises.

In one form, a bar is attached to the first carabiner and the second carabiner. The bar is positioned at a level to facilitate push-up exercises.

In one form, the invention is directed to an exercise device including a first pulley, a second pulley spaced horizontally apart from the first pulley, and a two ended line trained through the first and second pulley. The line has a first end and a second end. A first clamp and a second clamp are attached to the line between the line first end and the first pulley. A third clamp and a fourth clamp are attached to the line between the line second end and the second pulley. A first stirrup is attached to the first clamp. A second stirrup is attached to the fourth clamp. A first handle is attached to the second clamp. A second handle is attached to the third clamp. The first handle and first stirrup are spaced apart along the line to permit a user to place the user's foot in the stirrup and grasp the handle with the user's hand. The second handle and second stirrup are spaced apart along the line to permit a user to place the user's foot in the stirrup and grasp the handle with the user's hand, and further allowing the user to bilaterally work the line to simulate climbing.

In one form, the invention further includes a first spring assembly. The spring assembly has a first end and a second end. The first end is coupled to the first pulley. The second end is coupled to a fixed position.

In one form, the invention further includes a second spring assembly having a first end and a second end. The first end of the second spring assembly is attached to the second pulley. The second end of the second spring assembly is attached to a second fixed position horizontally displaced from the first fixed position.

In one form, the first spring assembly includes a first eyebolt attached to a second plate. A second eyebolt is attached to a first plate. A spring is captured between the first plate and the second plate.

In one form, the eyebolts have shafts axially displaced from one another.

In one form, the spring is a coil spring. The shafts of the eyebolts are parallel to the axis of the coil.

DETAILED DESCRIPTION OF THE PREFERRED EMBODIMENT

Figure 1:
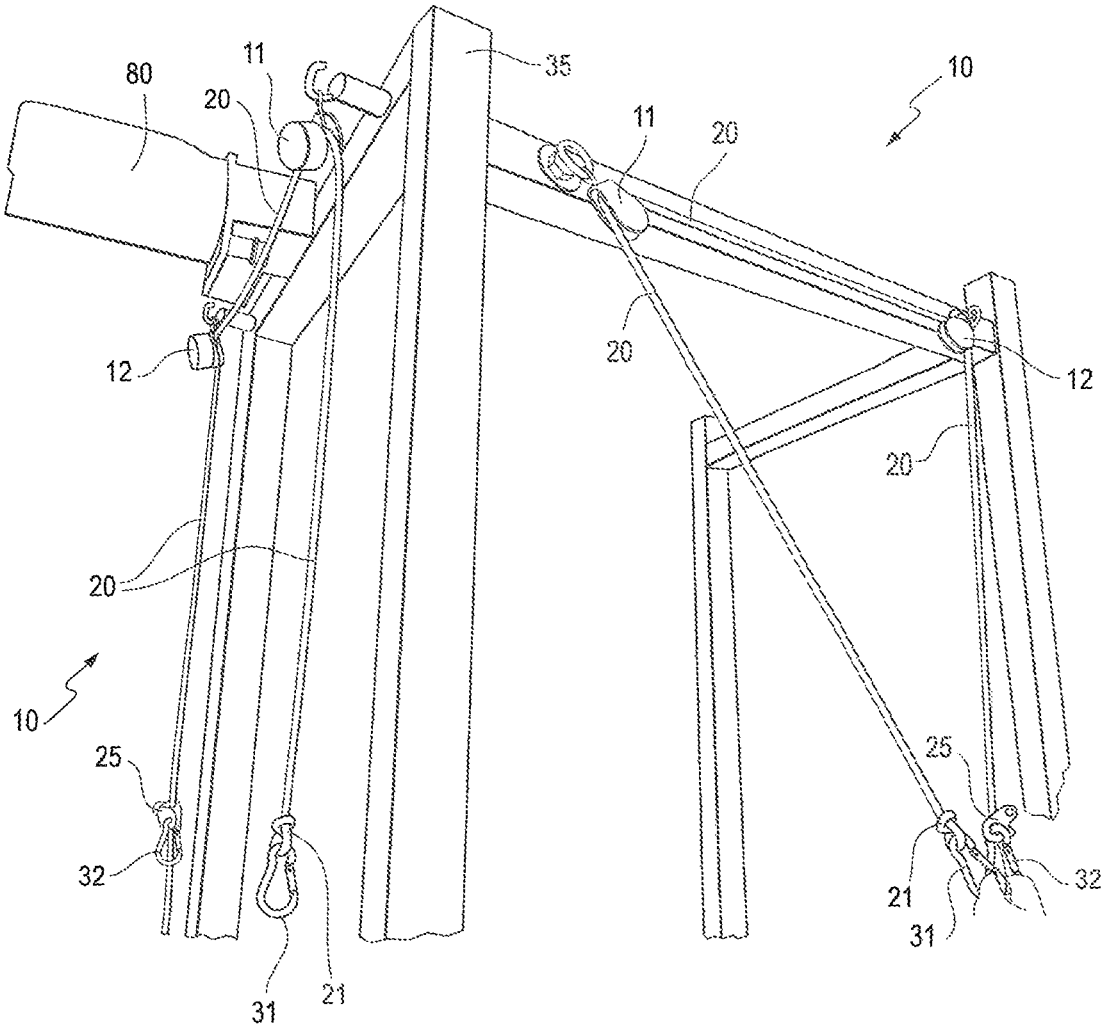
FIG. 1 shows the device of the present invention prior to the attachment of handles or bar.
Figure 2:
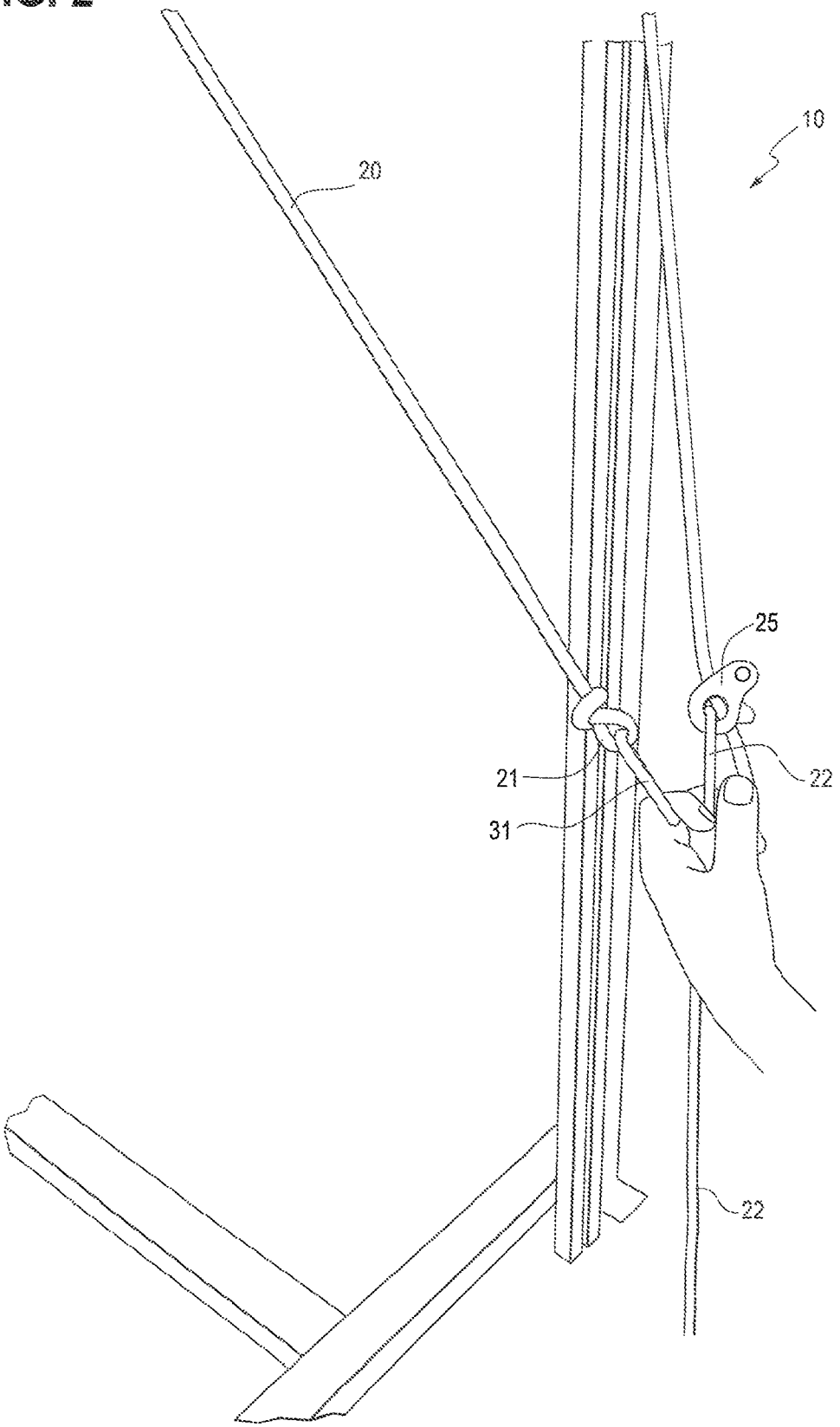
FIG. 2 is a close-up view of the first and second carabiners and clamp on the line.
Figure 3:
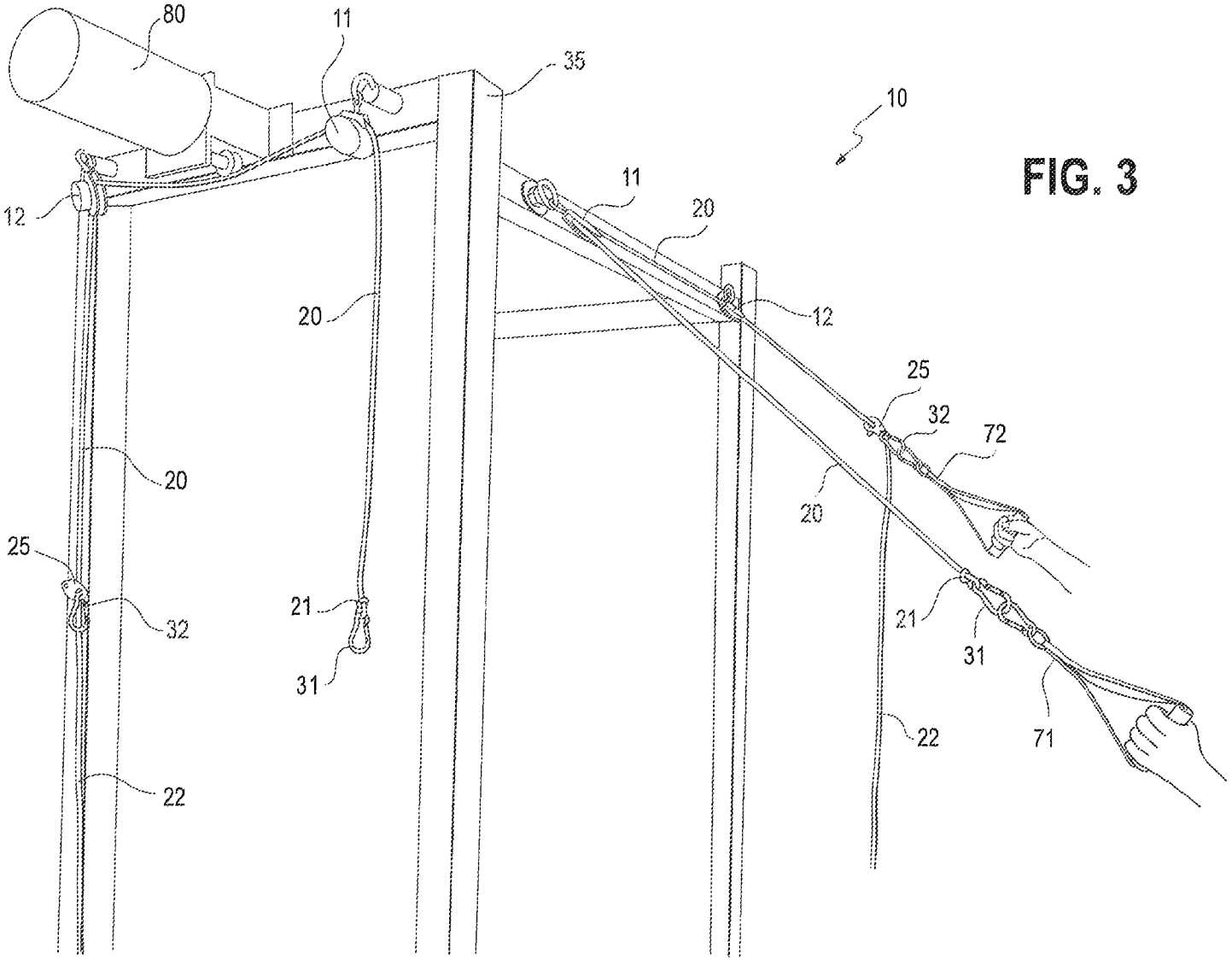
FIG. 3 shows the device of the present invention in use with handles attached.
Figure 4:
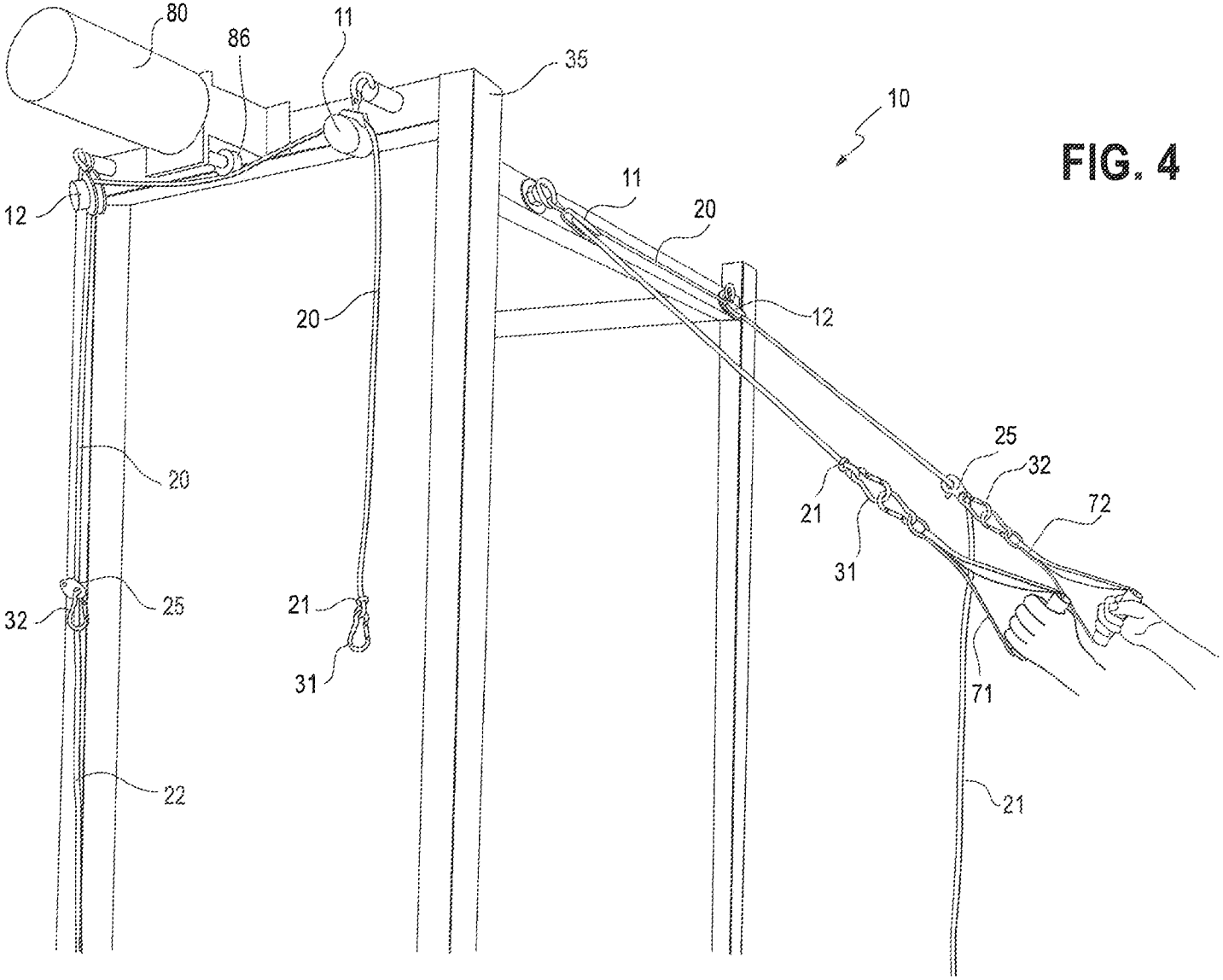
FIG. 4 shows the device of the present invention in use with handles attached.
Figure 5:
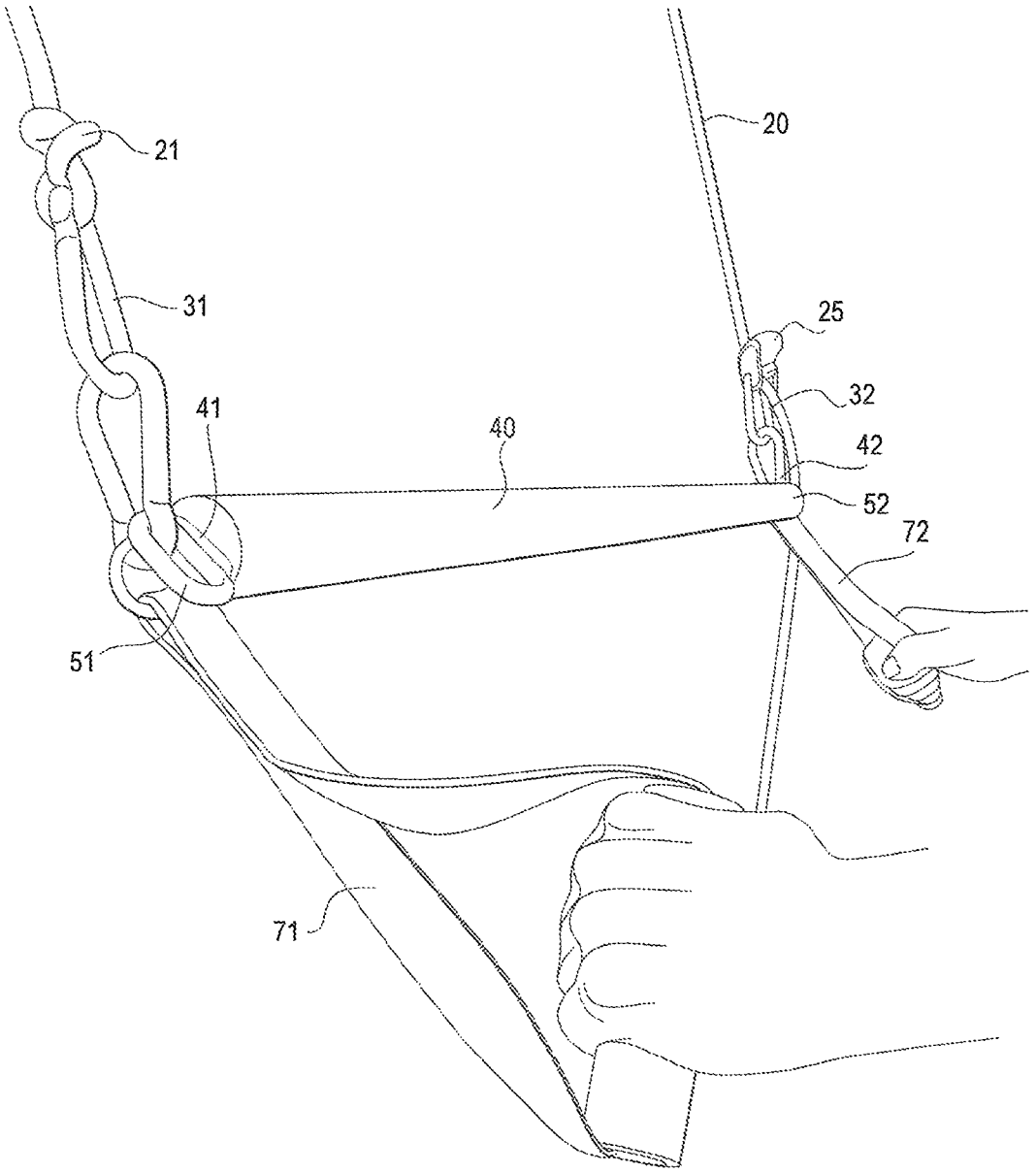
FIG. 5 is a close-up view of the bar and handles attached to the first and second carabiners by way of additional carabiners and shackles.
Figure 6:
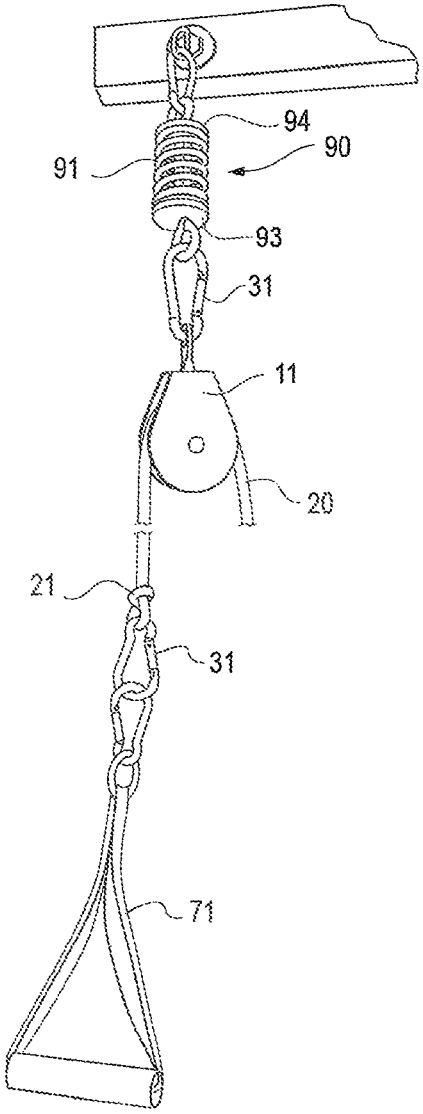
FIG. 6 shows the device of the present invention wherein the pulley is attached to a spring assembly.
Figure 6A:
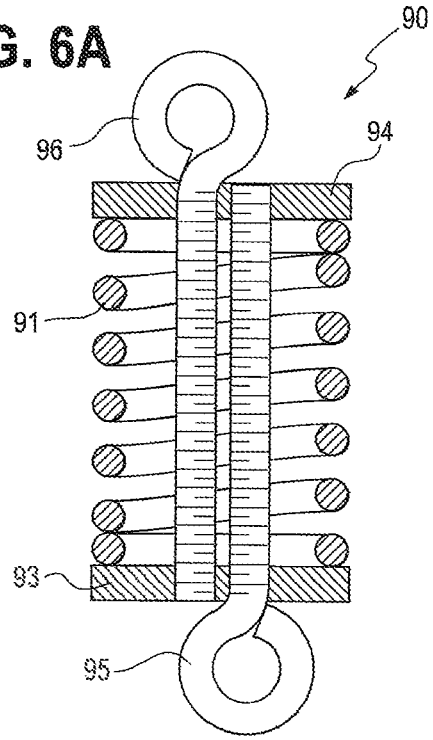
FIG. 6A shows a cross-sectional view of the spring assembly shown in FIG. 6.

The foregoing disclosure of specific embodiments is intended to be illustrative of the broad concepts comprehended by the invention. With reference to the figures, the exercise and training apparatus 10 in some embodiments includes a first pulley 11, a second pulley 12, and a line 20 having a line first end 21 and a line second end 22 trained through the first pulley 11 and second pulley 12.

The line first end 21 is connected to a first carabiner 31 by means of a knot. One skilled in the art will recognize that the line first end 21 can include an eye to allow connection of the first carabiner 31. One skilled in the art will also recognize that other structures allowing for easy attachment, removal, and reattachment of accessories and other devices may be substituted for the first carabiner 31, such as a shackle. One skilled in the art will also recognize that any number of attachment devices can be linked together as needed.

In some embodiments, the line second end 22 is generally free of attachments. A rope clutch or clamp 25 capable of capturing the line 20 is placed on the line 20 between the line second end 22 and the second pulley 12. The clamp 25 is capable of being selectively secured to the line 20 at locations between the line second end 22 and the second pulley 12, allowing any accessories attached to the clamp 25 to be positioned at various locations along the line 20. The clamp 25 includes a provision for attachment of a second carabiner 32, to allow easy attachment, removal, and reattachment of accessories to the clamp 25, and by extension, to the line 20.

In some embodiments, the first pulley 11 and second pulley 12 are secured to a rack 35 in a generally horizontal relationship. In the most preferred embodiments, the first pulley 11 is spaced apart from the second pulley 12 by at least 30 inches horizontally. In the most preferred embodiment, the first and second pulley are mounted approximately seven to nine feet off the floor, so that the apparatus 10 can be used or operated by a user in a standing position with arms above the user's head. The first and second pulleys 11 and 12 may be secured to the rack 35 by a swivel eye or swivel jaw, or other device familiar to one skilled in the art to allow the pulleys to accommodate various angles between the line 20 and the rack 35 that may occur as the apparatus 10 is used or operated by the user. In other embodiments, the first and second pulleys 11 and 12 may incorporate a swiveling head, and including a swiveling post that is positioned radially from the sheave of the pulley.

Figure 7:
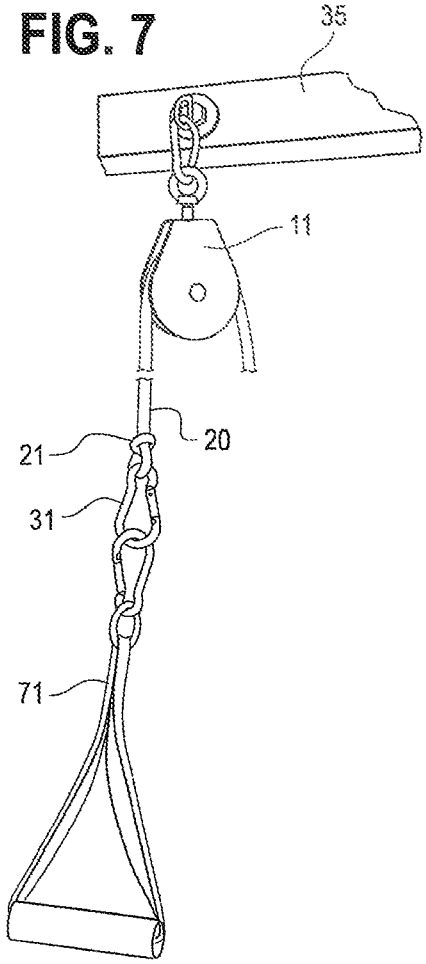
FIG. 7 shows the device of the present invention using a single pulley mounted to a fixed position.
Figure 8:
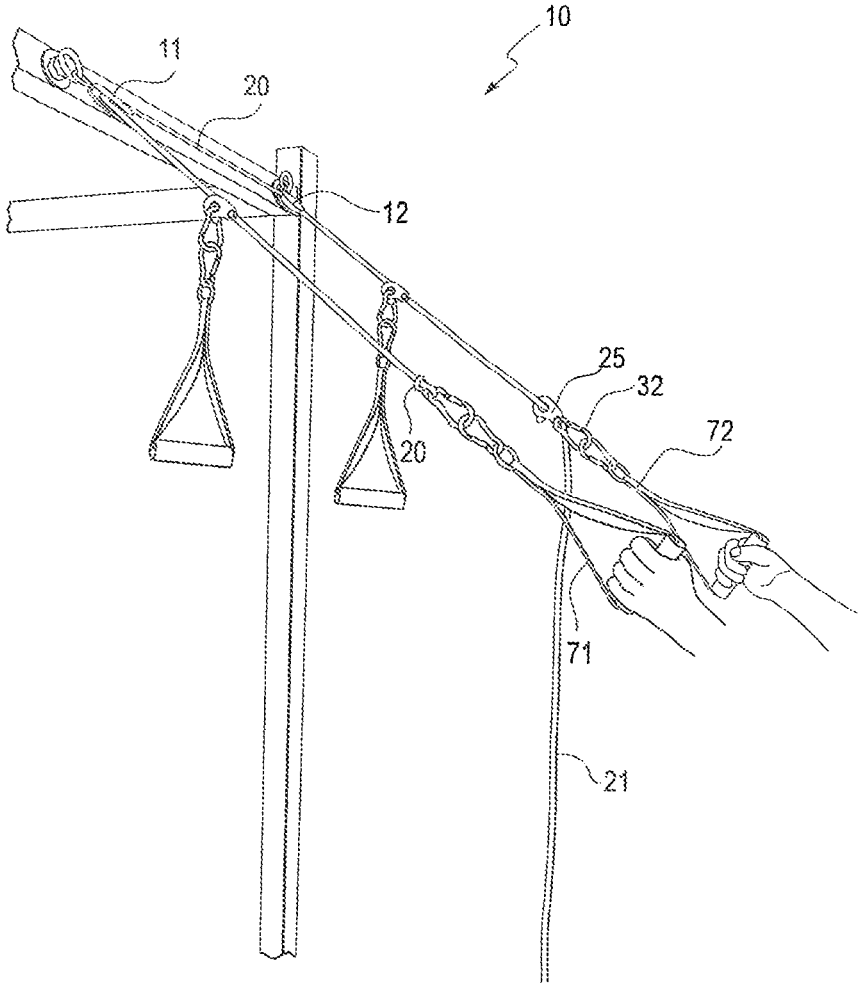
FIG. 8 shows an embodiment of the present invention including two handles and two stirrups.

In some embodiments, such as shown in FIG. 7, only a single pulley 11 is used. In other embodiments, more than two pulleys are used.

In some embodiments the apparatus 10 includes a gripping bar 40. The bar includes a first bar end 41 and a second bar end 42. The bar is preferably round in cross-section, and may include an outer sleeve or sleeves that are free to rotate about a major axis of the bar 40. In the most preferred embodiment, the bar 40 is 30 to 36 inches long. In other embodiments, the bar 30 is longer than the horizontal distance between the first and second pulleys 11 and 12.

In some embodiments the bar includes a bar first end eye 51 and a bar second end eye 52 to allow selective attachment of the bar to the first carabiner 31 and second carabiner 32. When so attached, the bar 50 allows for unilateral exercise. When so attached, the height of the bar 50 above the ground may be adjusted by selectively moving or changing the clamp 25 position along the length of the line 20. For instance, the clamp 25 may be advanced along the line towards the line first end 21 to effectively shorten the distance along the line 20 between line first end 21 and the clamp 25, thereby raising the bar 50, as the user may desire when using the apparatus 10 for pull-ups. Similarly, moving the clamp 25 towards the line second end 22 effectively lengthens the distance along the line 20 between the line first end 21 and the clamp 25, thereby lowering the bar 50, as may be done when the user desires to use the apparatus 10 for push-ups.

In some embodiments, the bar first end eye 51 and bar second end eye 52 are attached to the bar 50 so that the eyes may swivel or rotate with respect to the bar. When so equipped, the bar 50 is free to rotate about its major axis and the outer sleeve is not needed.

In some embodiments, the apparatus 10 may include a first handle 71 and a second handle 72 to allow the user to bilaterally work the line 20. In such an embodiment, a first handle 71 is attached to the first carabiner 31 and a second handle 72 is attached to the second carabiner 32. The first and second handles 71 a 72 may be attached to the first and second carabiners 31 and 32 at the same time that the bar 50 is attached. With such an arrangement, the bar 50 acts to stabilize the distance between the first and second carabiners 31 and 32, or the attachment points on the line 20. In some embodiments the bar 50 can be utilized for exercises such as pull-ups or push-ups while the handles 71 and 72 are attached.

The handles 71 and 72 may be any device or structure that is convenient for the user to grasp in the user's hand. In the most preferred embodiment, the handle is a web of material that includes a first loop which is size to accept the hand of a user, and a second loop for attachment to a carabiner. In some embodiments, the first loop of the handles include a tube over a portion of the webbing to allow the user a non-flexible area for gripping the handle. In other embodiments, the handles 71 and 72 are constructed of metal and have a triangular shaped portion for gripping by the user, with an eye or other attachment structure fixed at an apex of the triangle, the eye sized to be accepted by the first or second carabiner 31 and 32 for attachment to the line 20.

The handles 71 and 72 may also be used as stirrups for use with the user's feet. In such an embodiment, the user would place his feet into the handles 71 and 72, and grasp the line 20 at locations located above the handles 71 and 72, and alternately work the line 20 up and down in an action simulating climbing. In other embodiments, the apparatus 10 may include a plurality of rope clamps 25 to provide a plurality of attachment points for accessories such as disclosed herein. For instance, a second rope clamp can be positioned between the rope clamp 25 and the second pulley 12. A third handle is attached to the second rope clamp, allowing the user to better grip when compared to grasping the rope when performing a climbing simulation. Similarly, a third rope clamp can be positioned between the first carabiner 31 and the first pulley 11. A fourth handle is attached to the third rope clamp, allowing the user to have an improved grip.

In other embodiments, the first carabiner can be eliminated and replaced with a rope clamp. In other words, in such embodiments there is no need to provide a fixed attachment point or an accessory. Attachments to the line 10 can be accomplished using rope clamps, allowing for adjustability and customization for particular exercises and users.

In other embodiments, the apparatus 10 may include a device for applying resistance to the movement of the line 20. The resistance device 80 may be mounted on the rack 35 and engage the line 20 at a location along its length. In the most preferred embodiment, the resistance device 80 is positioned to engage the line 20 where the line runs between the first pulley 11 and the second pulley 12. The resistance device 80 includes a pulley, wheel, or sheave 86 that engages the line 20 so that linear movement of the line 20 is converted into rotational motion of the sheave. The sheave may then drive an input shaft to the resistance device 80. On skilled in the art will recognize that the resistance device 80 may provide resistance by many means, including hydraulics, electronics, or magnets.

In other embodiments, any of the pulleys may be attached to a fixed position by a resistance or spring assembly 90. The resistance assembly need not include a spring, but may functionally provide resistance or an opposing force to resist or prevent the pulley 11 from moving away from the fixed position on the rack 35 or other mounting point.

The spring assembly 90 includes a spring 91 or other device that reacts to weight, pulling, or other force directed away from the fixed position such as a rack 35. The spring assembly 90 can provide resistance to the bilateral motion that is proportional to the gravity load. It is preferred the spring assembly provide 100 pounds of resistance, but the amount may vary, with between 25 and 200 being a preferred range. In some embodiments, the spring assembly is compressed. In other embodiments, it may be stretched, with the rebound providing the force or resistance.

The spring assembly includes a spring 91 captured between a first plate 93 and a second plate 94. The plates 93 and 94 need not be plates and may have any configuration that may act upon and produce force against the spring 91. The plates 93 and 94 are preferably disks with the same diameter as the spring 91.

The spring assembly may also include a first eyebolt 95 and a second eyebolt 96. The first eyebolt 95 is axially offset from the second eyebolt 96. The first eyebolt 95 goes through the first plate 93 and is connected to the second plate 94. Thus the first eyebolt 95 is free to move with respect to the first plate 94. Similarly the second eyebolt 96 goes through the second plate 94 and is connected to the first plate 93. The eyebolts may be connected by fasteners, adhesives, welding, or other means known to one skilled in the art. One skilled in the art will recognize that the eyebolts 95 and 96 may be any structure that allows connection to the plate and to the pulley or fixed position as needed. In some embodiments, the shafts of the eyebolts 95 and 96 are within the coil of the spring 91. In other embodiments, the spring 91 may be acted upon by other structures to achieve compression.

In some embodiments, the first eyebolt 95 is connected to the pulley 11 by a carabiner 31. The second eyebolt 96 is connected to a fixed position or rack 35 by a carabiner. One skilled in the art will recognize other structures may be used to connect the pieces of the device. When a user bilaterally pulls on the rope 20, the force compresses the spring and thereby provides an increase in the linear force the user feels at the handles.

One skilled in the art will recognize that multiple spring assemblies 90 may be used serially or in parallel to achieve greater force experienced by the user.

One skilled in the art will recognize that other assemblies and structures may be used to resistively connect the pulley to a fixed position.

The embodiments described herein are mere examples and are not meant to limit the scope of the inventions described herein.

The invention claimed is:

1. An exercise device including a first pulley, a second pulley spaced horizontally apart from the first pulley, and a line trained through the first and second pulley, the line having a first end and a second end, a first clamp and a second clamp attached to the line between the first end and the first pulley, and a third clamp and a fourth clamp attached to the line between the second end and the second pulley, a first stirrup attached to the first clamp, a second stirrup attached to the fourth clamp, a first handle attached to the second clamp, and a second handle attached to the third clamp, the first handle and first stirrup spaced apart along the line and configured to permit a user to place a first foot in the first stirrup and grasp the first handle with a first hand, the second handle and second stirrup spaced apart along the line to permit the user to place a second foot in the second stirrup and grasp the second handle with a second hand, and thereby allowing the user to bilaterally work the line to simulate climbing.

2. The exercise device of claim 1, further including a first spring assembly, the first spring assembly having a first end and a second end, the first end coupled to the first pulley and the second end coupled to a first fixed position.

3. The exercise device of claim 2, further including a second spring assembly having a first end and a second end, the first end of the second spring assembly attached to the second pulley, and the second end of the second spring assembly attached to a second fixed position horizontally displaced from the first fixed position.

4. The exercise device of claim 3, wherein the first spring assembly includes a first eyebolt attached to a first plate, and a second eyebolt attached to a second plate, and further including a spring captured between the first plate and the second plate.

5. The exercise device of claim 4, wherein the first and second eyebolts have shafts, the shafts being axially displaced from one another.

6. The exercise device of claim 5, wherein the spring is a coil spring, and the shafts of the first and second eyebolts are parallel to an axis of the coil spring.

* * * * *